US008454119B2

(12) United States Patent
Lin et al.

(10) Patent No.: US 8,454,119 B2
(45) Date of Patent: Jun. 4, 2013

(54) INKJET PRINTING APPARATUS

(75) Inventors: Wuu-Jyi Lin, Taipei Hsien (TW); Chen-Hsing Cheng, Hsinchu (TW); Tsung-Yu Hung, Hsinchu (TW); Cheng-Nan Ho, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 360 days.

(21) Appl. No.: 12/893,200

(22) Filed: Sep. 29, 2010

(65) Prior Publication Data

US 2011/0261109 A1 Oct. 27, 2011

(30) Foreign Application Priority Data

Apr. 21, 2010 (TW) ..... 99112440 A

(51) Int. Cl.
*B41J 2/165* (2006.01)

(52) U.S. Cl.
USPC ..... 347/28

(58) Field of Classification Search
None
See application file for complete search history.

(56) References Cited

U.S. PATENT DOCUMENTS 7,690,741 B2 * 4/2010 Tyvoll et al. ..... 347/7
2007/0052767 A1 * 3/2007 Guhse et al. ..... 347/84

* cited by examiner

*Primary Examiner* — Matthew Luu
*Assistant Examiner* — Justin Seo
(74) *Attorney, Agent, or Firm* — Altis Law Group, Inc.

(57) ABSTRACT

An inkjet printing apparatus includes an inkjet print-head, an ink inlet conduit, a vacuum device, and a cleaning assembly. The inkjet print-head defines a number of nozzles. The ink inlet conduit is connected to the inkjet print-head and communicates with the nozzles. The cleaning assembly includes a cleaning member defining a cleaning groove. The vacuum device is connected to the inkjet print-head to impel cleaner received in the cleaning groove to flow through the nozzles along a direction reverse of a direction the ink is jetted.

12 Claims, 5 Drawing Sheets

INKJET PRINTING APPARATUS

RELATED APPLICATIONS

This application claims all benefits accruing under 35 U.S.C. §119 from Taiwan Patent Application No. 99112440, filed on Apr. 21, 2010 in the Taiwan Intellectual Property Office, the contents of which are hereby incorporated by reference.

BACKGROUND

1. Technical Field

The present disclosure relates to inkjet printing apparatuses, and particularly, to an inkjet printing apparatus capable of automatically cleaning the print-head of the inkjet printing apparatus.

2. Description of Related Art

Inkjet printing apparatuses require a maintenance assembly to keep nozzles of print-head operating properly, and prevent the jetted ink which remains in the nozzles from drying and clogging one or more of the nozzles during periods of non-use.

A typical inkjet printing apparatus capable of automatically cleaning a print-head includes a print-head and a maintenance assembly. The print-head includes a nozzle plate defining a number of nozzles. The maintenance assembly can spray clean the nozzle plate during idle periods to clean jetted ink remaining on the nozzle plate.

However, while cleaning, a water film may be formed on the nozzle plate and less cleaner can flow into the nozzles. Thus, the maintenance assembly may remove the jetted ink remaining on the nozzle plate, but fails to remove the jetted ink remaining in the nozzles.

Therefore, there is room for improvement within the art.

BRIEF DESCRIPTION OF THE DRAWINGS

The components in the drawings are not necessarily drawn to scale, the emphasis instead being positioned upon clearly illustrating the principles of the present disclosure. Moreover, in the drawings, like reference numerals designate corresponding parts throughout the views.

DETAILED DESCRIPTION

Figure 1:
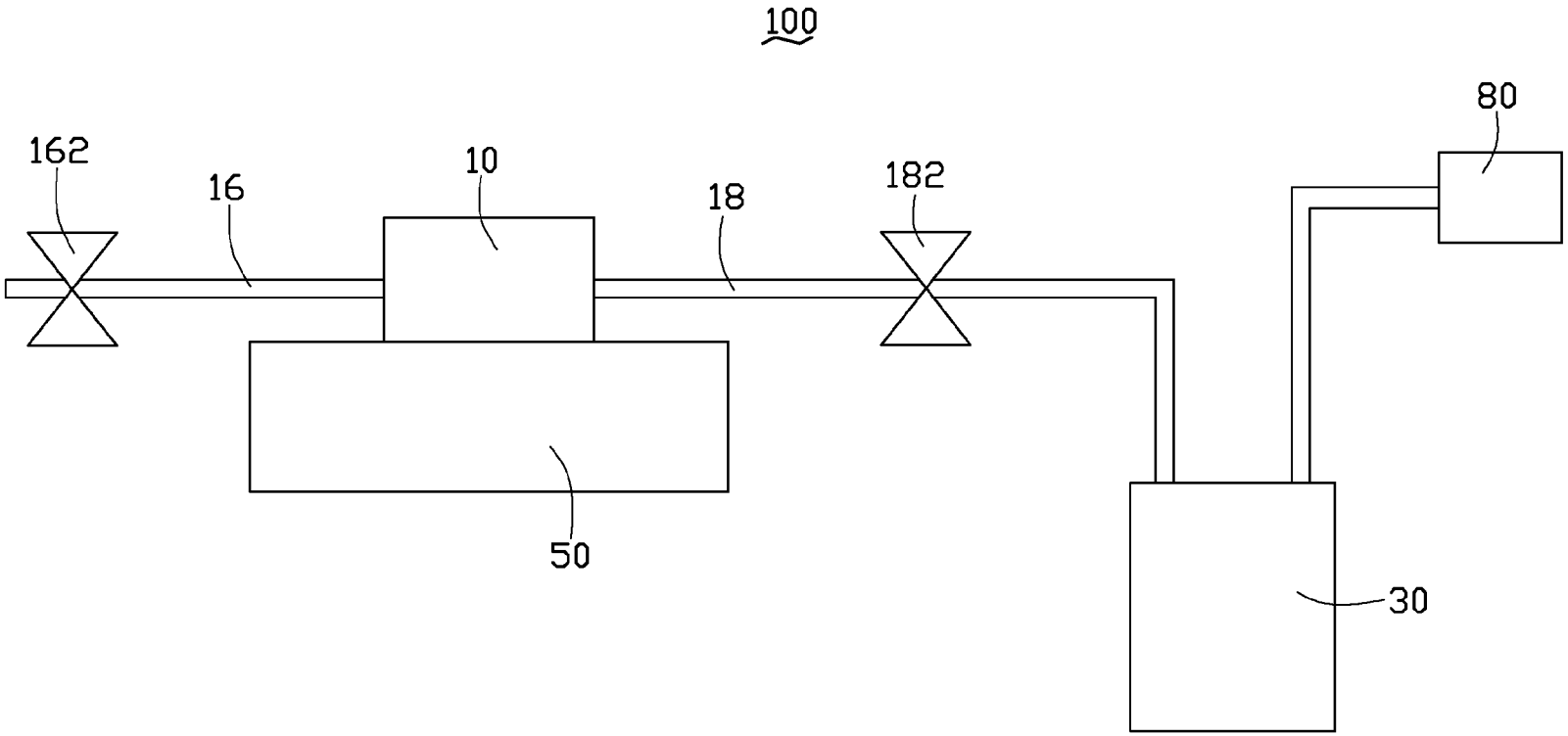
FIG. 1 is a schematic view of an embodiment of an inkjet printing apparatus, the inkjet printing apparatus including a print-head, a maintenance assembly, a vacuum tank, and a vacuum-device.
Figure 2:
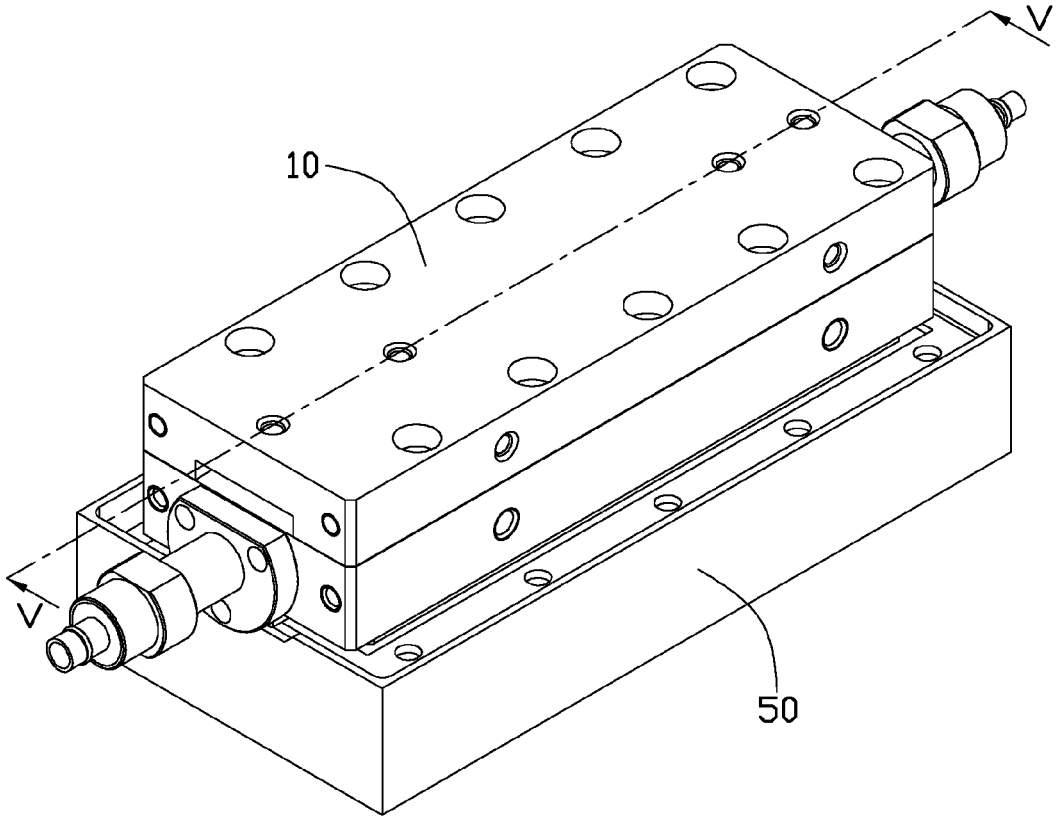
FIG. 2 is an assembled, isometric view of the print-head and the maintenance assembly of the inkjet printing apparatus of FIG. 1.

Referring to FIG. 1 and FIG. 2, an embodiment of an inkjet printing apparatus 100 includes an inkjet print-head 10, a vacuum tank 30, a maintenance assembly 50, and a vacuum device 80. The inkjet printing apparatus 100 includes various modules for printing. However, for simplicity, only the inkjet print-head 10 and the maintenance assembly 50 related to the inkjet printing apparatus 100 is described.

Figure 3:
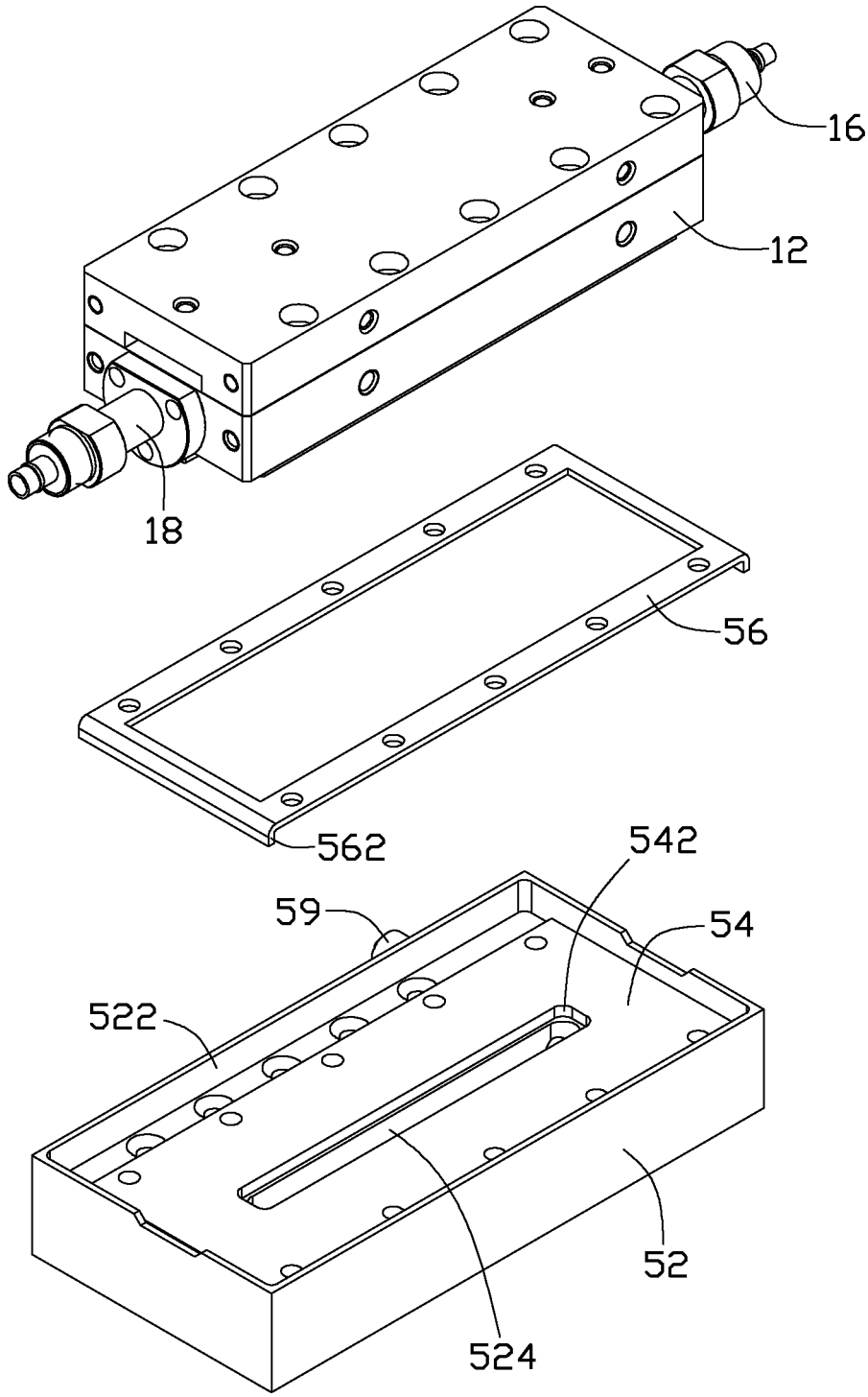
FIG. 3 is an exploded, isometric view of the print-head and the maintenance assembly of FIG. 2.
Figure 4:
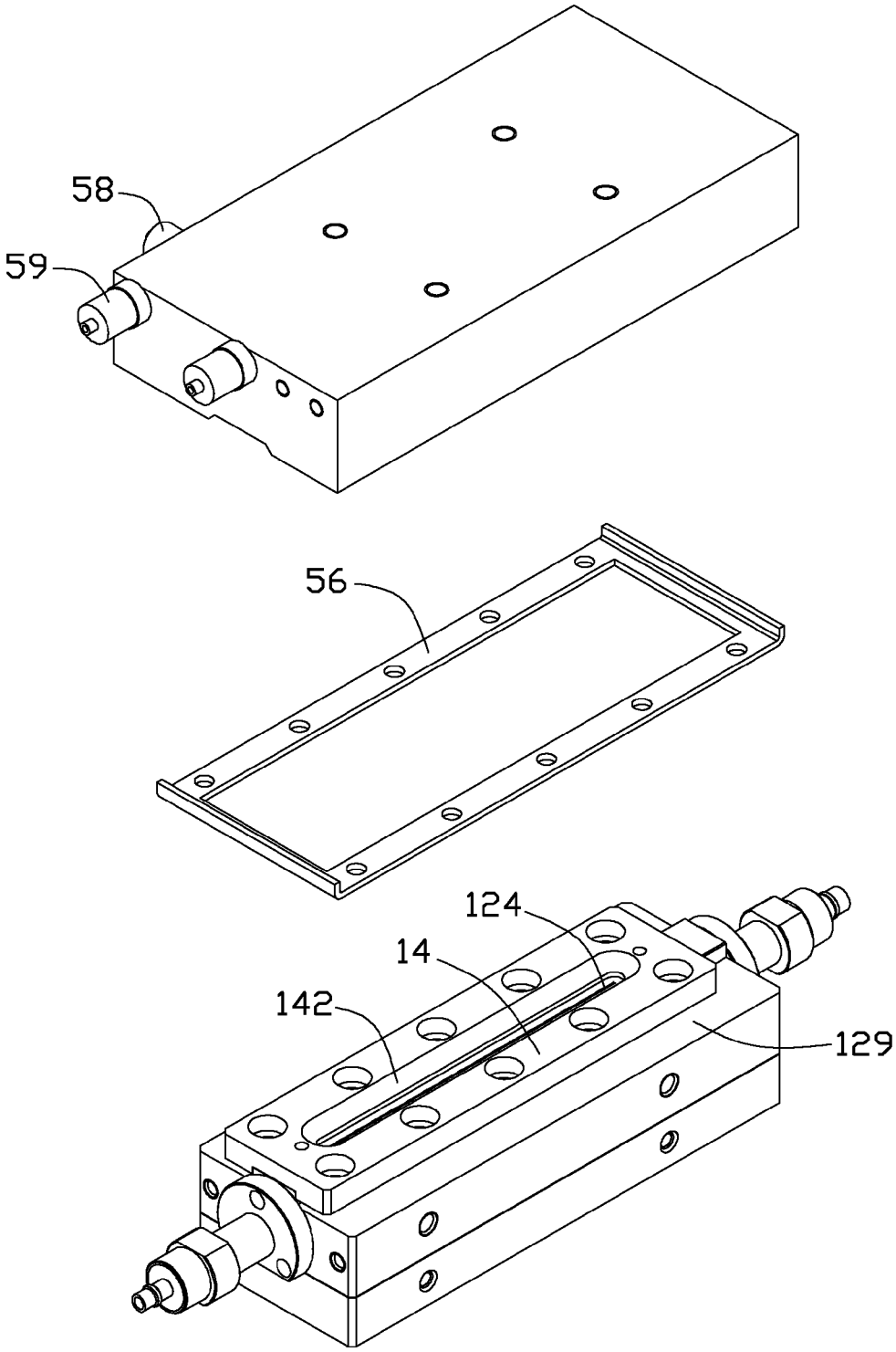
FIG. 4 is similar to FIG. 3, but viewed from another aspect.
Figure 5:
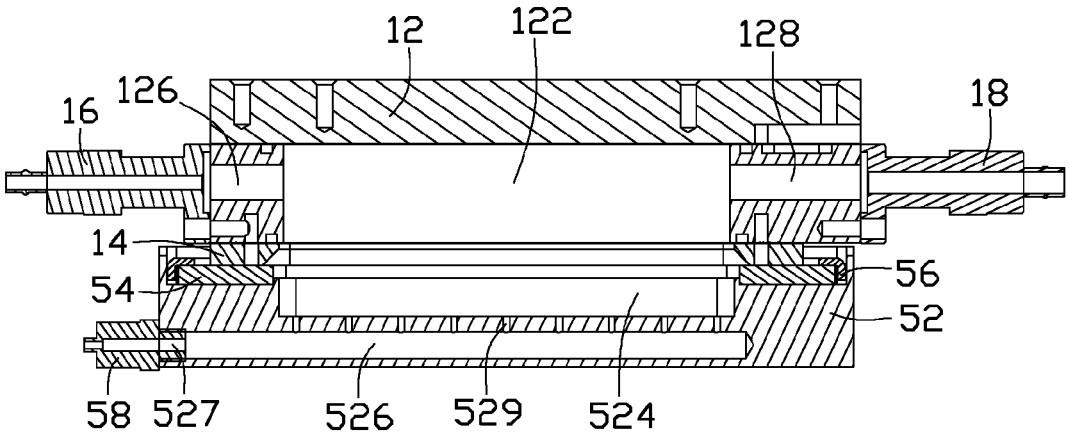
FIG. 5 is a cross section of the print-head and the maintenance assembly taken along line V-V shown in FIG. 2.

Referring to FIG. 3 through FIG. 5, the inkjet print-head 10 includes a main body 12, a resisting portion 14, an ink inlet conduit 16, and a cleaner exit conduit 18.

The main body 12 is substantially a rectangular block, and defines an ink reservoir 122, a number of nozzles 124, an ink inlet 126, and a cleaner exit hole 128. The main body 12 includes a working surface 129. The nozzles 124 are defined in the working surface 129 and communicate with the ink reservoir 122. In the illustrated embodiment, the nozzles 124 are aligned in a line. The ink inlet 126 and the cleaner exit hole 128 are defined in opposite side surfaces of the main body 12 and both communicate with the ink reservoir 122.

The resisting portion 14 is a substantially rectangular board protruding from the working surface 129. The resisting portion 14 defines an engaging slot 142 corresponding to the nozzles 124. The engaging slot 142 is substantially an elongated through slot.

Referring to FIG. 1 and FIG. 5 again, the ink inlet conduit 16 is connected to the main body 12 through the ink inlet 126, such that ink in the ink inlet conduit 16 can be injected into the ink reservoir 122. The ink inlet conduit 16 is equipped with a valve 162 to adjust the flow of the ink. The cleaner exit conduit 18 is connected to the main body 12 through the cleaner exit hole 128. An end of the cleaner exit conduit 18 is connected to the vacuum tank 30. The cleaner conduit 16 is equipped with a valve 162. The vacuum tank 30 is connected to the vacuum device 80.

Referring to FIG. 3 through FIG. 5, the maintenance assembly 50 includes a cleaning member 52, a seal plate 54, a fixing member 56, a cleaner inlet conduit 58, and a cleaner outlet conduit 59. The cleaning member 52 is substantially a rectangular block defining a receiving groove 522, a cleaning groove 524, a cleaner path 526, a cleaner inlet 527, a cleaner outlet (not shown), and a number of through holes 529. The receiving groove 522 is formed at one end of the cleaning member 52, while the cleaner path 526 is defined in an opposite end of the cleaning member 52. The cleaning groove 524 is formed in a bottom of the receiving groove 522 and has a shape corresponding to the engaging slot 142 of the inkjet print-head 10. The number of through holes 529 communicate between cleaner path 526 and the cleaning groove 524. The cleaner inlet 527 and the cleaner outlet communicate with the cleaner path 526 and run through an outer surface of the cleaning member 52. The cleaner inlet conduit 58 is connected to the cleaning member 52 through the cleaner inlet hole 527, such that the cleaner is capable of being injected into the cleaner path 526. The cleaner outlet conduit 59 is connected to the cleaning member 52 by the cleaner outlet to release the waste cleaner remaining in the cleaner path 526.

The seal plate 54 is a sheet, and defines a through hole 542 having a shape corresponding to the engaging slot 142 of the inkjet print-head 10. The seal plate 54 is elastic and has a good chemical resistance. The seal plate 54 is received in the receiving groove 522 corresponding to the cleaning groove 524.

The fixing member 56 is a substantially rectangular frame. The fixing member 56 includes a pair of curved fixing portions 562 at two opposite ends of the fixing member 56. The fixing member 56 is received in the receiving groove 522 and contacts with the seal plate 54. The pair of fixing portions 562 are respectively inserted between two opposite ends of the seal plate 54 and two opposite sidewalls of the receiving groove 522, such that the seal plate 54 is fixed to the bottom of the receiving groove 522 of the cleaning member 52. It should be pointed out that the fixing member 56 and the seal plate 54 may be fixed to the cleaning member 52 with fasteners, such as screws.

The inkjet printing apparatus 100 may further include a control system (not shown). The maintenance of the inkjet print-head 10 is automatically controlled by the control system. During cleaning, the control system energizes a print-head drive motor (not shown) to move the inkjet print-head 10 to the cleaning member 52. The inkjet print-head 10 is received in the receiving groove 522, the resisting portion 14 resists the seal plate 54, and the engaging slot 142 corresponds to the cleaning groove 524. The valve 182 is opened and the valve 162 is closed, at the same time, the cleaner inlet conduit 58 is opened and the cleaner outlet conduit 59 is closed, such that cleaner fed by the cleaner inlet conduit 58 flows into the cleaner path 526, and finally to the cleaning groove 524 through the through holes 529. The vacuum device 80 is turned on, the cleaner in the cleaning groove 524 is impelled to flow into the ink reservoir 122 by the nozzles 124, and then finally the waste cleaner is impelled into the vacuum tank 30. After the cleaning is completed, the control system energizes the print-head drive motor to move the inkjet print-head 10 away from the maintenance assembly 50. The vacuum device 80, the valve 182, and the cleaner inlet conduit 58 are then closed, and the cleaner outlet conduit 59 is opened to discharge the waste cleaner remaining in the cleaning groove 524 and the cleaner path 526. When the inkjet printing apparatus 100 is ready for printing, the control system opens the valve 162 to allow ink to flow into the ink reservoir 122.

The cleaner is received in the cleaning groove 524 and then impelled by the vacuum device 80, so relatively more cleaner is impelled to the ink reservoir 122 by the nozzles 124. The cleaning press is relative high, and the cleaner flows through the nozzles along a direction opposite the direction the ink is jetted, such that the inkjet printing apparatus 100 has an enhanced cleaning effect.

It is to be understood that the cleaner outlet hole 128 may be omitted. The cleaner exit conduit 18 is connected to the ink inlet conduit 16 directly with a tie-in positioned between the ink inlet hole 126 and the valve 162. During cleaning, the valve 162 is closed. During printing, the valve 182 is also closed.

It is believed that the present embodiments and their advantages will be understood from the foregoing description, and it will be apparent that various changes may be made thereto without departing from the spirit and scope of the disclosure or sacrificing all of its material advantages.

What is claimed is:

1. An inkjet printing apparatus, comprising:

an inkjet print-head defining a number of nozzles;

an ink inlet conduit connected to the inkjet print-head and communicating with the nozzles;

a vacuum device; and a cleaning assembly comprising a cleaning member defining a cleaning groove, wherein the vacuum device is connected to the inkjet print-head to impel cleaner received in the cleaning groove to flow through the nozzles along a direction reverse of a direction ink is jetted.

2. The inkjet printing apparatus of claim 1, further comprising a vacuum tank and a cleaner exit conduit, wherein the cleaner exit conduit communicates the nozzles with the vacuum tank, and the vacuum tank is connected to the vacuum device.

3. The inkjet printing apparatus of claim 1, wherein the cleaning member further comprises a cleaner inlet conduit, the cleaning member defines a cleaner path, a cleaner inlet communicating with the cleaner path, and a number of through holes communicating between the cleaner path and the cleaning groove, the cleaner inlet conduit is connected to the main body through the cleaner inlet.

4. The inkjet printing apparatus of claim 3, further comprising a maintenance assembly, wherein the maintenance assembly further comprises a cleaner outlet conduit, the cleaning member further defines a cleaner outlet communicating with the cleaner path, and the cleaner outlet conduit is connected to the cleaning member through the cleaner outlet.

5. The inkjet printing apparatus of claim 1, wherein the cleaning member further defines a receiving groove formed at one end of the cleaning member, and the cleaning groove is formed in a bottom of the receiving groove.

6. The inkjet printing apparatus of claim 5, wherein the cleaning assembly further comprises a seal plate fixed to the bottom of the receiving groove, and the seal plate defines a through hole having a shape corresponding to the cleaning groove.

7. The inkjet printing apparatus of claim 6, wherein the cleaning assembly further comprises a fixing member mounting the seal plate on the cleaning member.

8. The inkjet printing apparatus of claim 7, wherein the fixing member comprises a pair of curved fixing portions at two opposite ends of the fixing member, and the pair of the fixing portions are inserted between two opposite ends of the seal plate and two opposite sidewalls of the receiving groove to fix the seal plate to the cleaning member.

9. The inkjet printing apparatus of claim 6, wherein the seal plate is elastic.

10. The inkjet printing apparatus of claim 2, wherein the ink inlet conduit is equipped with a first valve, the cleaner exit conduit is equipped with a second valve, and the cleaner exit conduit is connected to the ink inlet conduit with a tie-in positioned between the inkjet print-head and the first valve of the ink inlet conduit.

11. The inkjet printing apparatus of claim 2, wherein the inkjet print-head comprises a main body defining an ink reservoir, an ink inlet, and a cleaner exit hole; all of the nozzles, the ink inlet, and the cleaner exit hole communicate with the ink reservoir; the ink inlet conduit is connected to the main body through the ink inlet hole; an end of the cleaner exit conduit away from the vacuum tank is connected to the main body through the cleaner exit hole.

12. The inkjet printing apparatus of claim 1, wherein the inkjet print-head comprises a resisting portion defining an engaging slot corresponding to the nozzles, the resisting portion is configured to resist the cleaning member, and the engaging slot corresponds to the cleaning groove.

* * * * *